US010386129B2

(12) United States Patent
Turnbull et al.

(10) Patent No.: US 10,386,129 B2
(45) Date of Patent: Aug. 20, 2019

(54) HEADER PLATE FOR A HEAT EXCHANGER

(71) Applicant: DENSO Marston Ltd., West Yorkshire (GB)

(72) Inventors: Jonathan Turnbull, West Yorkshire (GB); Mario Ciaffarafa, West Yorkshire (GB); Andrew Diakiw, West Yorkshire (GB)

(73) Assignee: DENSO Marston Ltd., West Yorkshire (GB)

( * ) Notice: Subject to any disclaimer, the term of this patent is extended or adjusted under 35 U.S.C. 154(b) by 0 days.

(21) Appl. No.: 15/609,192

(22) Filed: May 31, 2017

(65) Prior Publication Data

US 2017/0350661 A1 Dec. 7, 2017

(30) Foreign Application Priority Data

Jun. 2, 2016 (GB) ..... 1609678.6
Mar. 23, 2017 (GB) ..... 1704628.5

(51) Int. Cl.

| | |
|---|---|
| ***F28F 9/06*** | (2006.01) |
| ***F28F 1/02*** | (2006.01) |
| ***F28F 9/02*** | (2006.01) |
| ***B21D 19/08*** | (2006.01) |
| ***B21D 31/02*** | (2006.01) |
| ***B21D 53/02*** | (2006.01) |

(Continued)

(52) U.S. Cl.

CPC ..... *F28F 9/06* (2013.01); *B21D 19/088* (2013.01); *B21D 31/02* (2013.01); *B21D 53/02* (2013.01); *F28F 1/02* (2013.01); *F28F 9/02* (2013.01); *F28F 9/0224* (2013.01); *F28F 9/182* (2013.01); *F28D 2021/0082* (2013.01); *F28D 2021/0089* (2013.01); *F28D 2021/0091* (2013.01); *F28F 2275/122* (2013.01); *F28F 2280/00* (2013.01)

(58) Field of Classification Search

CPC .... F28F 9/02; F28F 9/0246; F28F 9/06; F28F 9/08; F28F 9/12; F28F 9/182; F28F 9/0224; F28F 1/02; F02B 29/045; F28D 1/05366; B21D 19/088; B21D 31/02; B21D 53/02

See application file for complete search history.

(56) References Cited

U.S. PATENT DOCUMENTS 5,228,512 A * 7/1993 Bretl ..... F28F 9/18 165/153
5,327,959 A * 7/1994 Saperstein ..... F28D 1/05391 165/153

(Continued)

FOREIGN PATENT DOCUMENTS

DE 3925733 A1 2/1990
EP 0990868 B1 8/2002

(Continued)

*Primary Examiner* — Tho V Duong

(57) ABSTRACT

A header plate includes slots to receive heat exchange tubes of a heat exchanger. Each slot includes a lip extending in a direction of the tubes. Each slot has straight sides and corners. At least two tabs extend from each lip. One tab is on one side of each lip, and another tab is on an opposite side of each lip. Tabs are absent from the corners of the lip. Each tab is turned out from the lip so that the tabs on the lip act as a lead in for a tube entering the slot. Each slot has two long sides opposite one another. At least one tab is on each long side of the lip.

17 Claims, 19 Drawing Sheets

(51) Int. Cl.
*F28F 9/18* (2006.01)
*F28D 21/00* (2006.01)

(56) References Cited

U.S. PATENT DOCUMENTS

| | | | | |
|---|---|---|---|---|
| 6,263,570 | B1 * | 7/2001 | Cazacu | F28D 1/05383 165/173 |
| 2003/0006028 | A1 * | 1/2003 | Kalbacher | F28D 1/0535 165/173 |
| 2006/0218791 | A1 * | 10/2006 | Lamkin | B21D 19/08 29/890.052 |
| 2007/0235175 | A1 * | 10/2007 | DeGroot | F28F 9/02 165/173 |
| 2010/0038063 | A1 * | 2/2010 | Saumweber | F28F 9/182 165/173 |
| 2014/0054018 | A1 * | 2/2014 | Augenstein | F02B 29/045 165/173 |
| 2015/0292813 | A1 | 10/2015 | Kaiser et al. | |

FOREIGN PATENT DOCUMENTS

| | | | | |
|---|---|---|---|---|
| GB | 2460728 | B | | 5/2010 |
| JP | 2005127595 | A | * | 5/2005 |
| JP | 2009-014270 | A | | 1/2009 |
| KR | 20110136083 | A | | 12/2011 |

* cited by examiner

STAGE 4

STAGE 5

STAGE 6

STAGE 7

HEADER PLATE FOR A HEAT EXCHANGER

CROSS REFERENCE TO RELATED APPLICATION

This application is based on United Kingdom Patent Applications No. 1609678.6 filed on Jun. 2, 2016 and No. 1704628.5 filed on Mar. 23, 2017, the disclosure of which is incorporated herein by reference.

TECHNICAL FIELD

The present disclosure relates to a header plate for a heat exchanger. The present disclosure further relates to a method of making a header plate for a heat exchanger.

BACKGROUND

Difficulty may arise in a process to connect heat exchange tubes with a header plate for a heat exchanger.

SUMMARY

It is an object of the present disclosure to produce a header plate for a heat exchanger, the header plate having a configuration protecting component from damage in its assembly process.

According to an aspect of the present disclosure, a header plate is for a heat exchanger. The header plate comprises a unit to connect to a header tank. The header plate further comprises a plurality of slots to receive heat exchange tubes of the heat exchanger; each slot including a lip extending in a direction of the tubes. Each slot has straight sides and having corners. The header plate further comprises at least two tabs extending from each lip in the direction of the tubes. At least one tab is on one side. At least one tab is on an opposite side of each lip. Tabs are absent from the corners of each lip. Each tab is turned out from the lip so that the tabs on the lip act as a lead in for a tube entering the slot. Each slot has two long sides opposite one another. At least one tab is on each long side of the lip.

According to another aspect of the present disclosure, a method of making a header plate, the method comprises coining a groove in a sheet metal blank. The method further comprises using a press tool, pressing the floor of the groove between two tool parts such that the floor of the groove cracks. The method further comprises pushing a tool through the floor of the groove to form a slot with a drawn lip therearound.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1A:
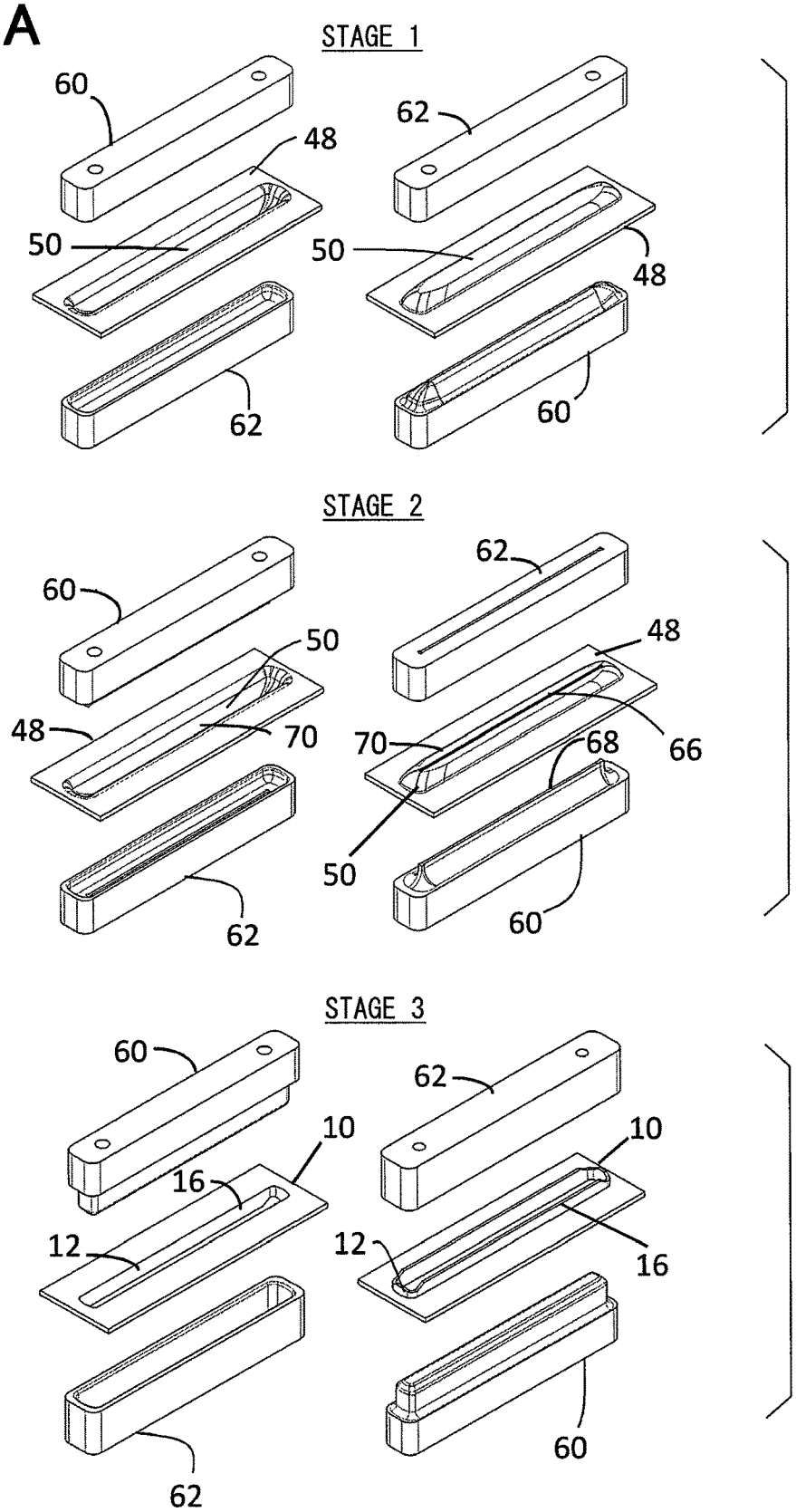
FIG. 1A shows the stages of fabrication of a header plate in the exemplified method.

FIGS. 2 to 5 show an exemplified header plate for a heat exchanger for a vehicle, such as a charge air cooler, radiator or oil cooler. The header plate 10 has a main part 8 defining a plurality of parallel elongate slots 12 to receive tubes 14. The header plate 10 is a so-called "inverted slot" header plate. Thus, a lip 16 extends from the edge of each slot 12 and in the present case it extends downwardly, towards the tubes 14 rather than upwardly, away from the tubes 14, which is the other exemplified arrangement. At each side of the main part 8 of the header plate 10 there is an upwardly bent connection flange 18 for connection to a header tank (not shown).

During normal operation of a heat exchanger in a vehicle, such as a charge air cooler, radiator or oil cooler, the heat exchanger is subjected to durability cycles of high pressures and temperatures leading to thermal stresses and strain in the heat exchanger components. Over time, because of the strain on these components, a failure may occur. The failure is commonly located at the braze joint between the tube 14 and the header plate slot 12, resulting in a tube failure. To minimise the likelihood of failure in the area, an inverted slot can be used, and this will locally strengthen the tube.

Where the slot is not inverted, the forming of the lip 16 creates a natural lead in for the tubes 14 to be received in the slots 12. That is not the case with an inverted slot.

Figure 4:
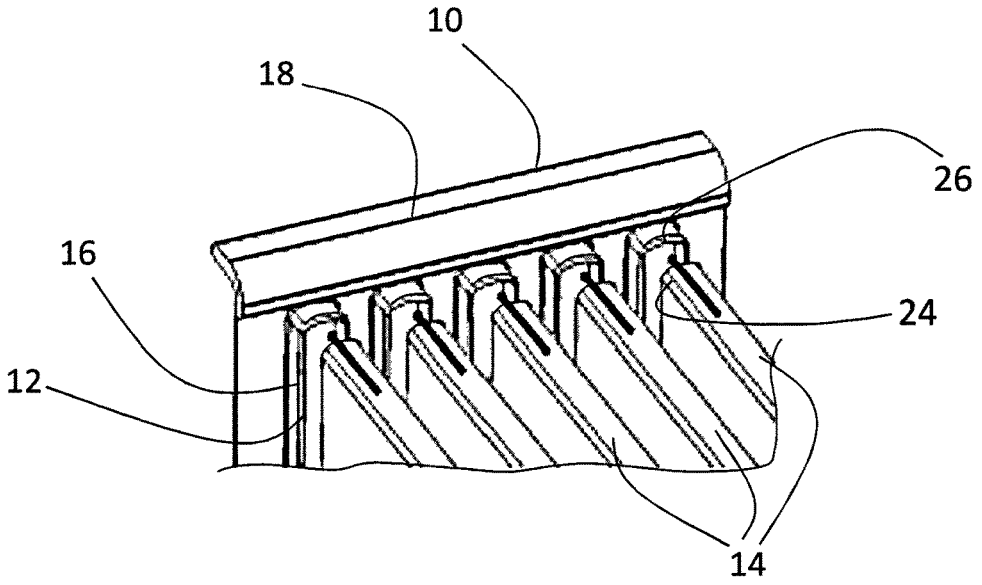
FIG. 4 is a perspective view from below showing the header plate of FIG. 3 being offered up to a series of heat exchanger tubes held in a jig of a build machine.
Figure 5:
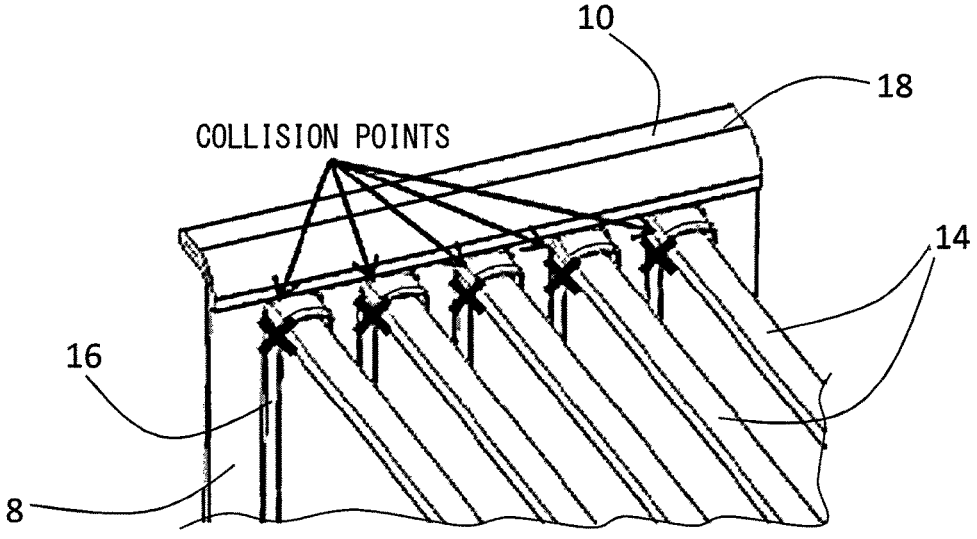
FIG. 5 is the view of FIG. 4 showing potential collision points.

FIG. 4 shows a plurality of tubes 14 assembled and clamped to a build machine (not shown), which then offers up the header plate 10 to the tubes 14. FIG. 5 shows the potential collision points. The collision can take place between the end 24 of a tube 14 and the end 26 of the lip 16, and this can result in damage and potentially the damage can be sufficiently severe for the heat exchanger components to be unusable.

Figure 6:
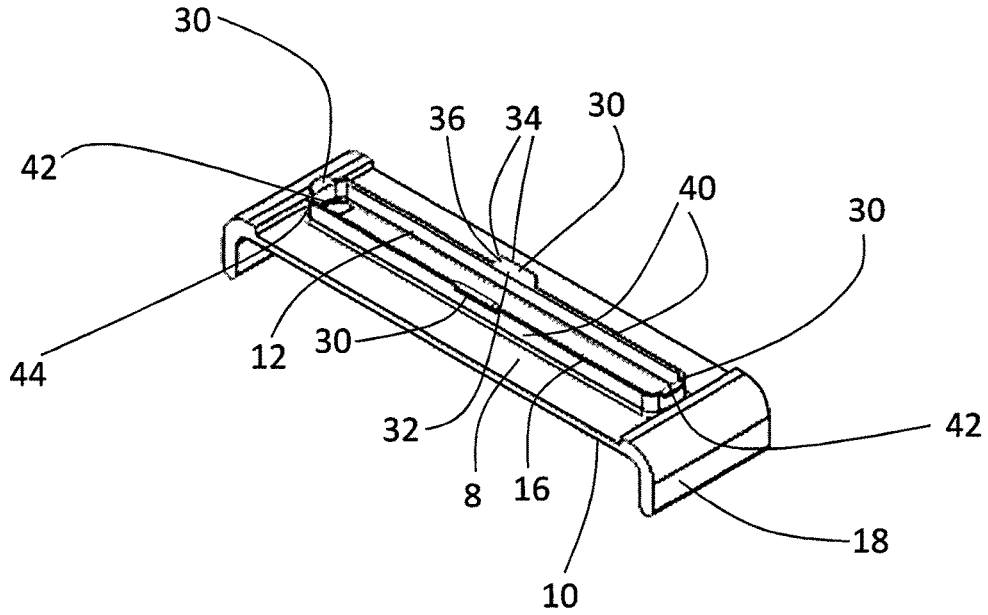
FIG. 6 is a perspective fragmentary view of part of a header plate in a first embodiment of the disclosure.
Figure 7:
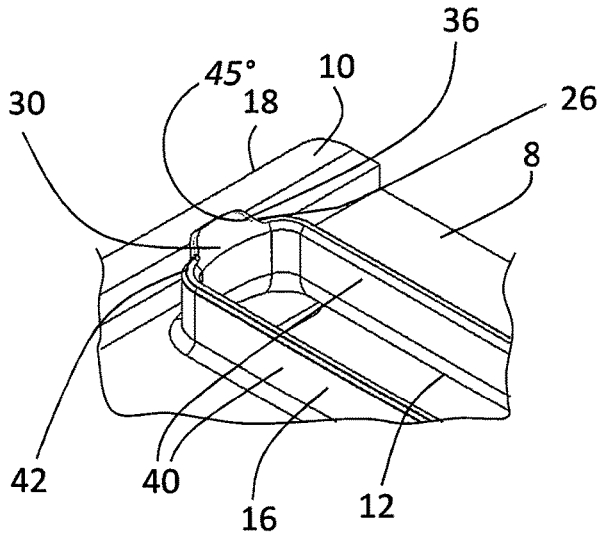
FIG. 7 is a detail view of one end of the header plate in FIG. 6.
Figure 8:
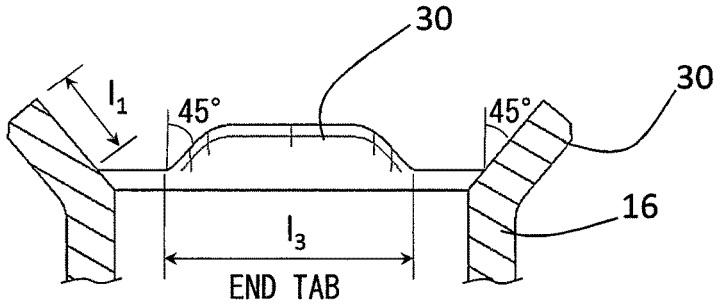
FIG. 8 is a fragmentary cross-section view across the center of the header plate of the first embodiment.
Figure 9:
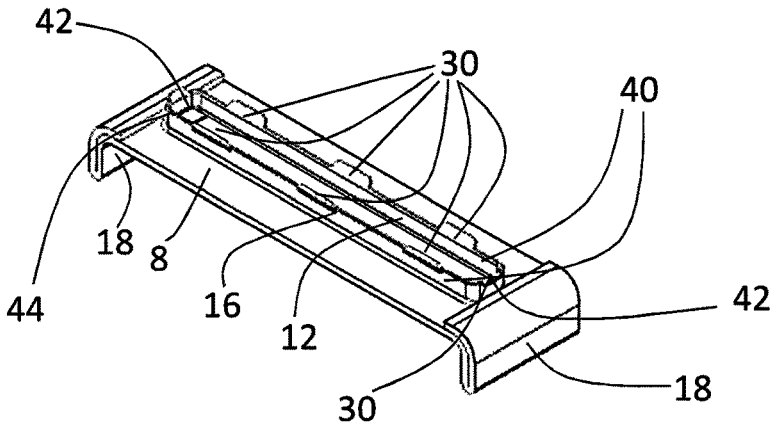
FIG. 9 is a perspective fragmentary view of part of a header plate in a second embodiment of the disclosure.
Figure 10:
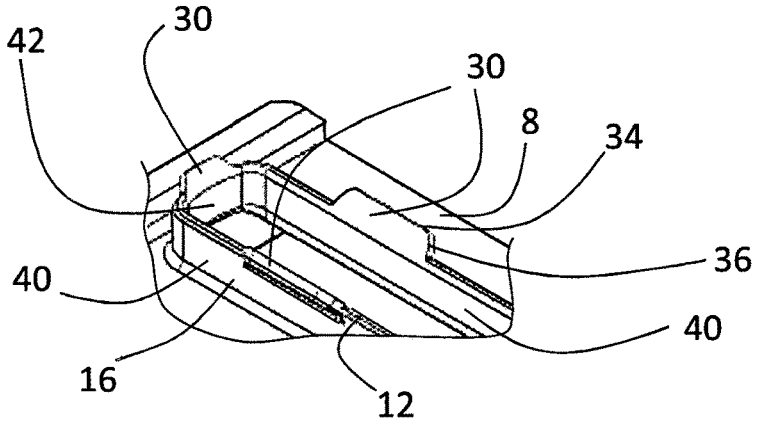
FIG. 10 is a detail view of one end of the header plate of FIG. 9.
Figure 11:
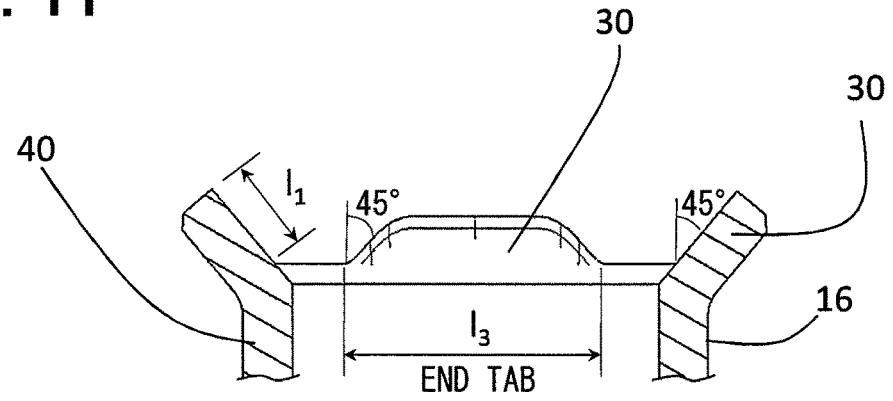
FIG. 11 is a fragmentary cross-section view across the center of the header plate of the second embodiment.

FIGS. 6 to 8 show the header plate 10 in a first embodiment of the disclosure.

The same reference numerals will be used for equivalent features and only the difference from the exemplified header plate 10 will be described.

A single slot 12 in the header plate 10 is shown, but this is just for clarity. The header plate 10 will include a plurality of slots 12 to receive a series of tubes 14 in the usual way.

The header plate 10 of the first embodiment includes a plurality of tabs 30 extending from the end 26 of the lip 16 of each slot 12. Each tab 30 is substantially trapezium shaped, having a broader base 32 connected to the lip 16 and a free edge 34, and slanted sides 36. In the first embodiment, each slot 12 is substantially rectangular so that each lip 16 has two long sides 40 opposite each other, and two short sides 42 opposite each other and four corners 44. Each short side 42 is not in fact straight, but is slightly curved, as shown in FIG. 6. Each short side 42 carries a tab 30, and there is also a tab 30 half way along each long side 40.

The header plate 10 of this embodiment is for a charge air cooler, and each slot 12 is 9 mm wide and 98 mm long, and the gauge of the aluminum sheet material from which the header plate 10 is made is 1.95 mm. The length "l" of each tab 30 from the end 26 of the lip 16 is 4 mm. The tab 30 on the short side 42 of the slot 12 is narrower than each tab 30 on each long side 40. Each short tab 30 is about 6 mm wide and each tab 30 on the long side 40 is about 10 mm wide. Each tab 30 is turned outwards from the direction of the extension of the lip 16 by an angle of about 45°. Each slanted side 36 of each tab 30 is at an angle of about 45° to the top of the lip 26, as shown in FIGS. 6 and 7. The dimensions of the slot of the embodiment can be within the following range: 5 mm to 10 mm wide, 50 mm to 125 mm long and between 1 mm to 5 mm material gauge.

FIGS. 9 to 12 show a second embodiment. The header plate 10 in the second embodiment is similar to the first and only the differences will be described.

In the heat exchanger of the second embodiment, instead of there being just one tab 30 on each long side 40 of each lip 16, there are three tabs 30. On each long side 40, there is a central tab 30 as before. In addition, there is a tab 30 situated with its center about 15% along the length of the long side 40 of the lip 16 from one short end 42, and the other tab 30 is in the same position at the other end of the side 40.

The three tabs 30 on one long side 40 are therefore at an equal spacing along the side 40 from one to the next. The tabs 30 on the long sides 40 are all identical.

In the second embodiment, the heat exchanger can be a radiator and each slot 12 is 2.5 mm wide and 60 mm in length with a material gauge of 0.6 mm. The length "l" of each tab is 1 mm. Each tab 30 in this embodiment is turned outwards from the lip by an angle of 40°. The dimensions of the slot of the embodiment can be within the following range: 1.8 mm to 5 mm wide, 16 mm to 98 mm long and between 0.6 mm to 2 mm material gauge.

Figure 12:
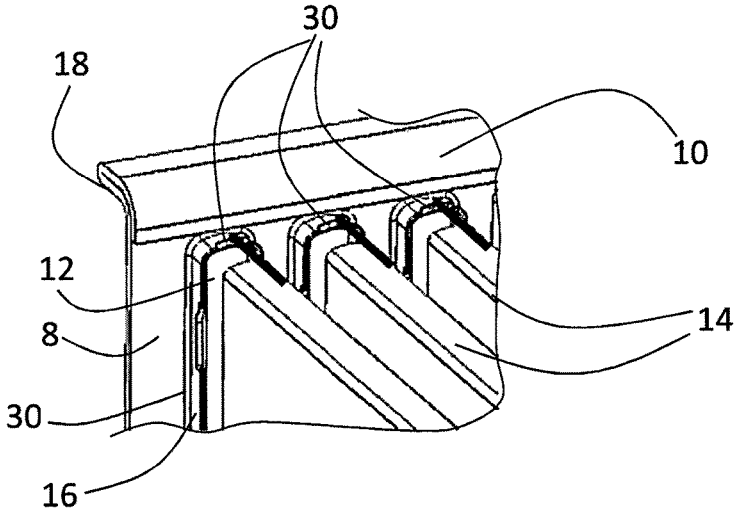
FIG. 12 is a perspective view showing the header plate of the second embodiment being offered up to a series of tubes held in a build machine.

FIG. 12 shows the tubes 14 and header plate 10 in a build machine (not shown), being brought together for assembly. The tabs 30 provide a lead in surface to guide the tubes 14 into alignment with the lips 16 and hence the slots 12. In this way, damage and wastage is avoided.

It is seen that, by putting tabs on both the side walls 40 and end walls (sides) 42, the tabs are for guidance in two perpendicular directions to ensure that misalignment in either of these two perpendicular directions is obviated.

Figure 13:
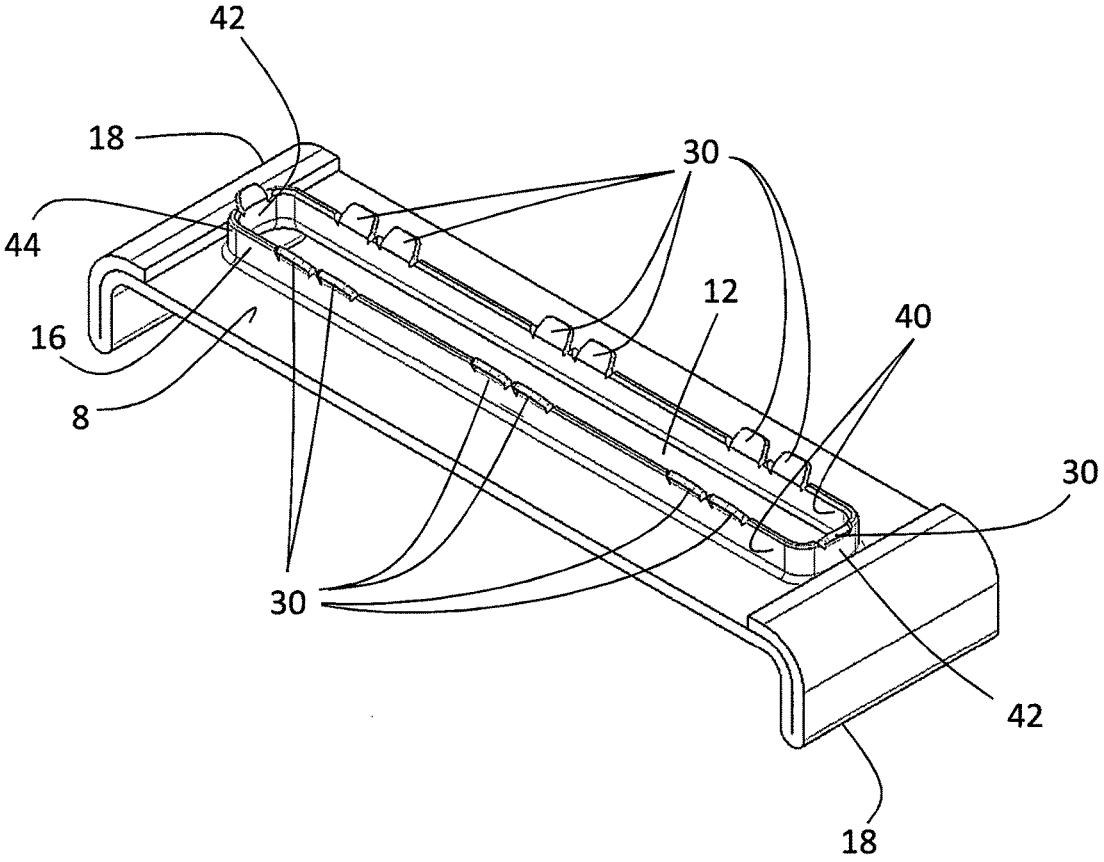
FIG. 13 is a perspective fragmentary view of part of a header plate in a third embodiment of the disclosure.
Figure 14:
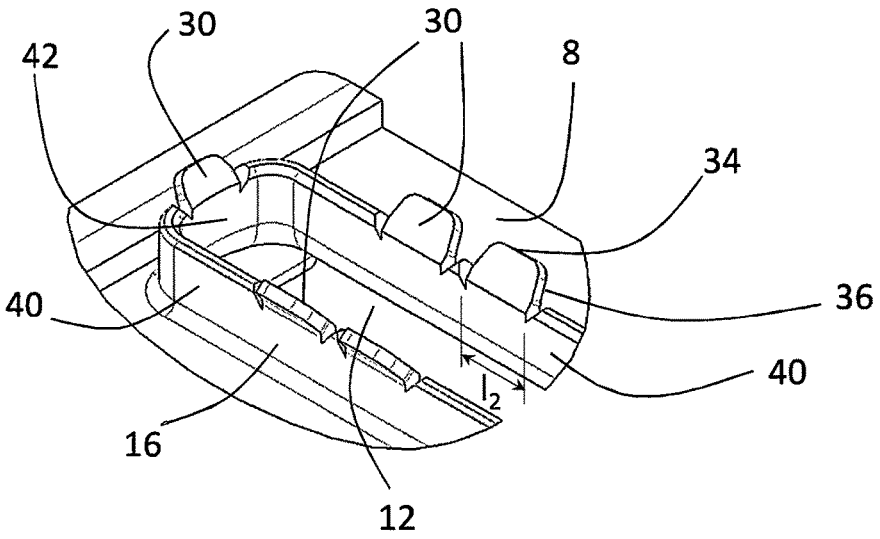
FIG. 14 is a detail view of one end of the header plate of FIG. 13.
Figure 15:
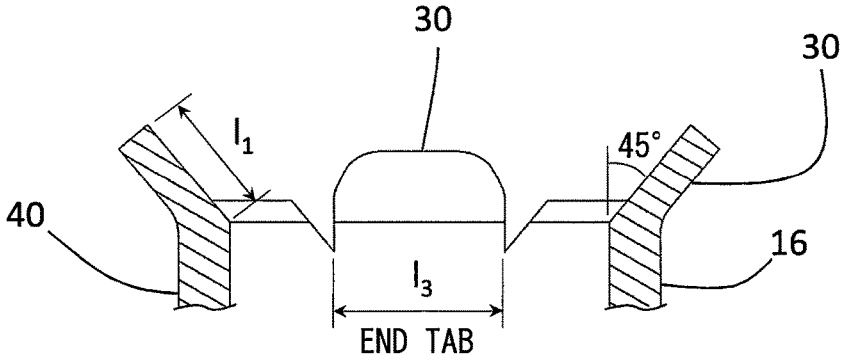
FIG. 15 is a fragmentary cross-section view across the center of the header plate of the third embodiment.

FIGS. 13 to 15 show a third embodiment. The header plate 10 in the third embodiment is similar to the second and only the differences will be described.

In this embodiment, the tabs 30 that are provided along each long side 40, at 33%, 50% and 66% along the length of each long side 40 are split in two smaller parts making double the number of tabs along each long side 40. The width 12 of each side tab 30 is 5 mm. The gauge of the aluminum is 1.95 mm, as previously mentioned. If the tab 30 is wider than about 7 mm, then, when in manufacture, the tab 30 is bent away from the lip 16, the lip 16 can be distorted. Distortion of the lip 16 can affect the fit between the header plate 10 and tube 14 creating a weakness or potentially a leak path. By reducing the width 12 of the tab 30, this problem is avoided. The width 13 of each end tab 30 is 4 mm, which is about 45% of the width of the slot 12.

Generally the tab width will be in the range 28 to 55% of the slot width.

Figure 16:
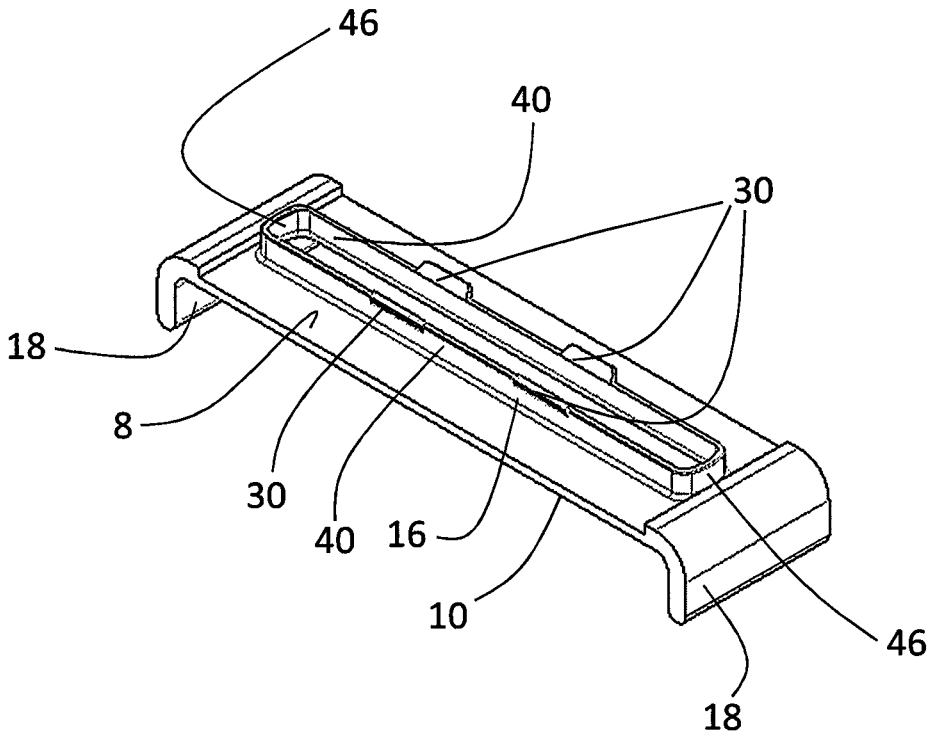
FIG. 16 is a perspective fragmentary view of part of a header plate in a fourth embodiment of the disclosure.

FIG. 16 shows a fourth embodiment. Only the differences from the first embodiment will be described.

In this embodiment, each end of the lip 16 is rounded so that it has a semi-circular shape in plan. Two tabs 30 are provided along each long side 40, at 33% and 66% along the length of each long side 40. There are no tabs at the ends of the slots 12 on the corners 46. In this case the header plate 10 is for an oil cooler, the dimensions of the slot of the embodiment can be within the following range: 2 mm to 5 mm wide, 20 mm to 98 mm long and between 1 mm to 5 mm material gauge.

In a variation on all the embodiments, a chamfer may be provided on the inside of the slot 12 at the end to act as a lead in, alternatively no lead in may be provided.

It will be seen that, in each of the four embodiments, tabs 30 are absent from the corners 44; 46 of the lips 16. This reduces the potential failure at that point. In order to have a tab at a corner 44; 46, the material would have to be flared more which would be more complicated to manufacture and would also result in significant material thinning and the potential for weakness. By leaving the tabs absent at the corners 44; 46, that potential problem is avoided.

Figure 17:
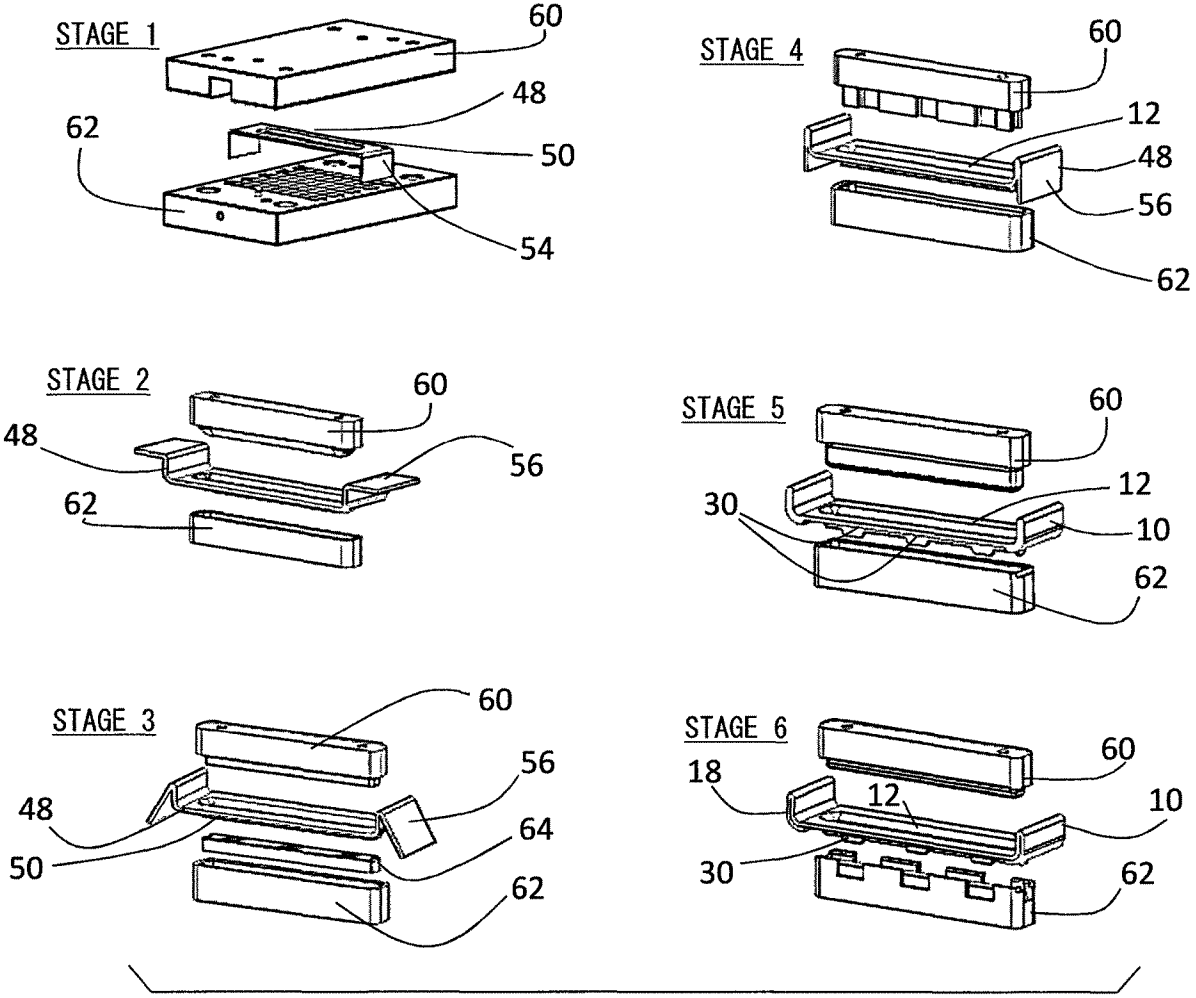
FIGS. 17, 18 and 19 show the stages of fabrication of the header plate of the second embodiment.
Figure 18:
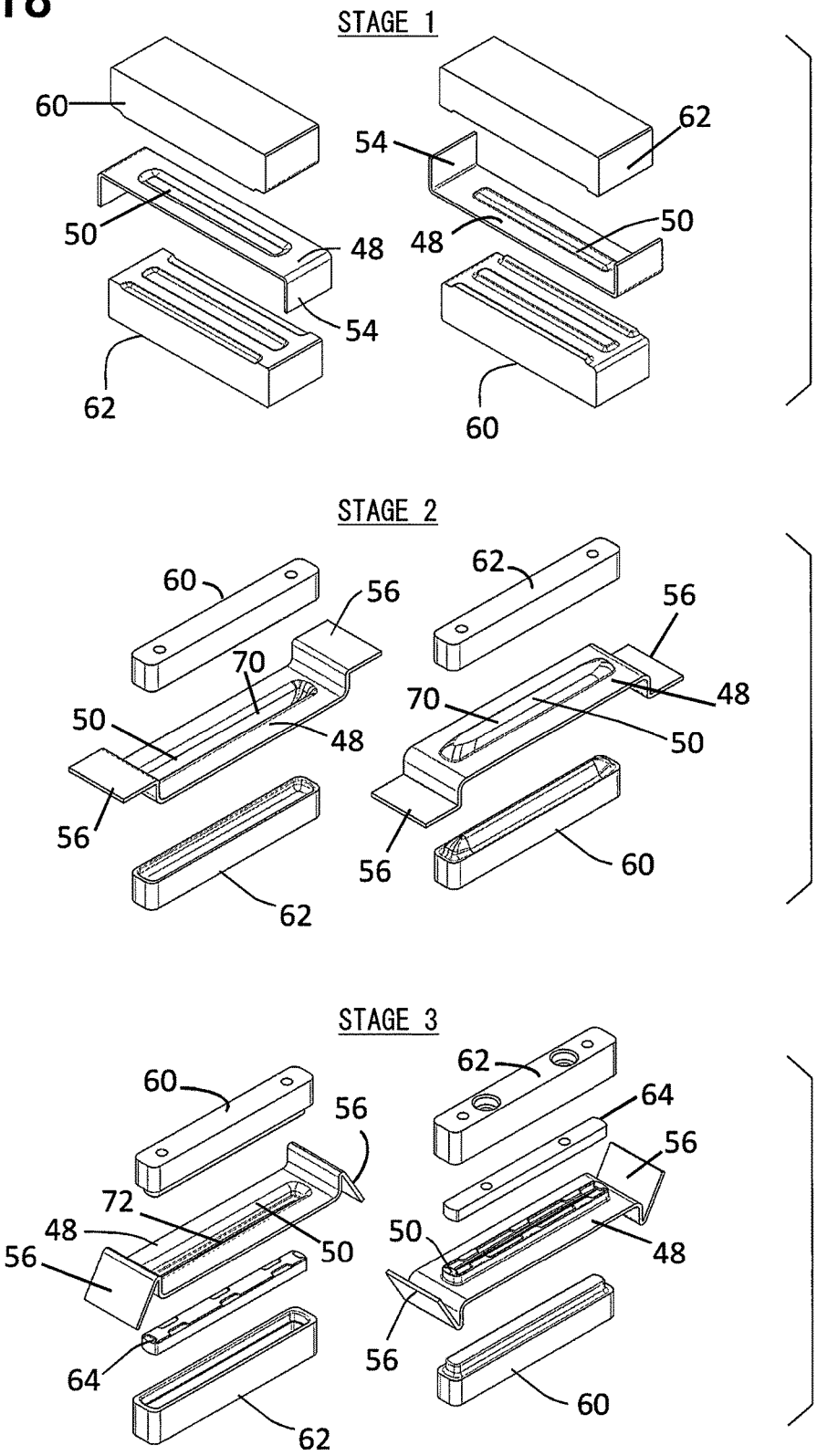
Figure 19:
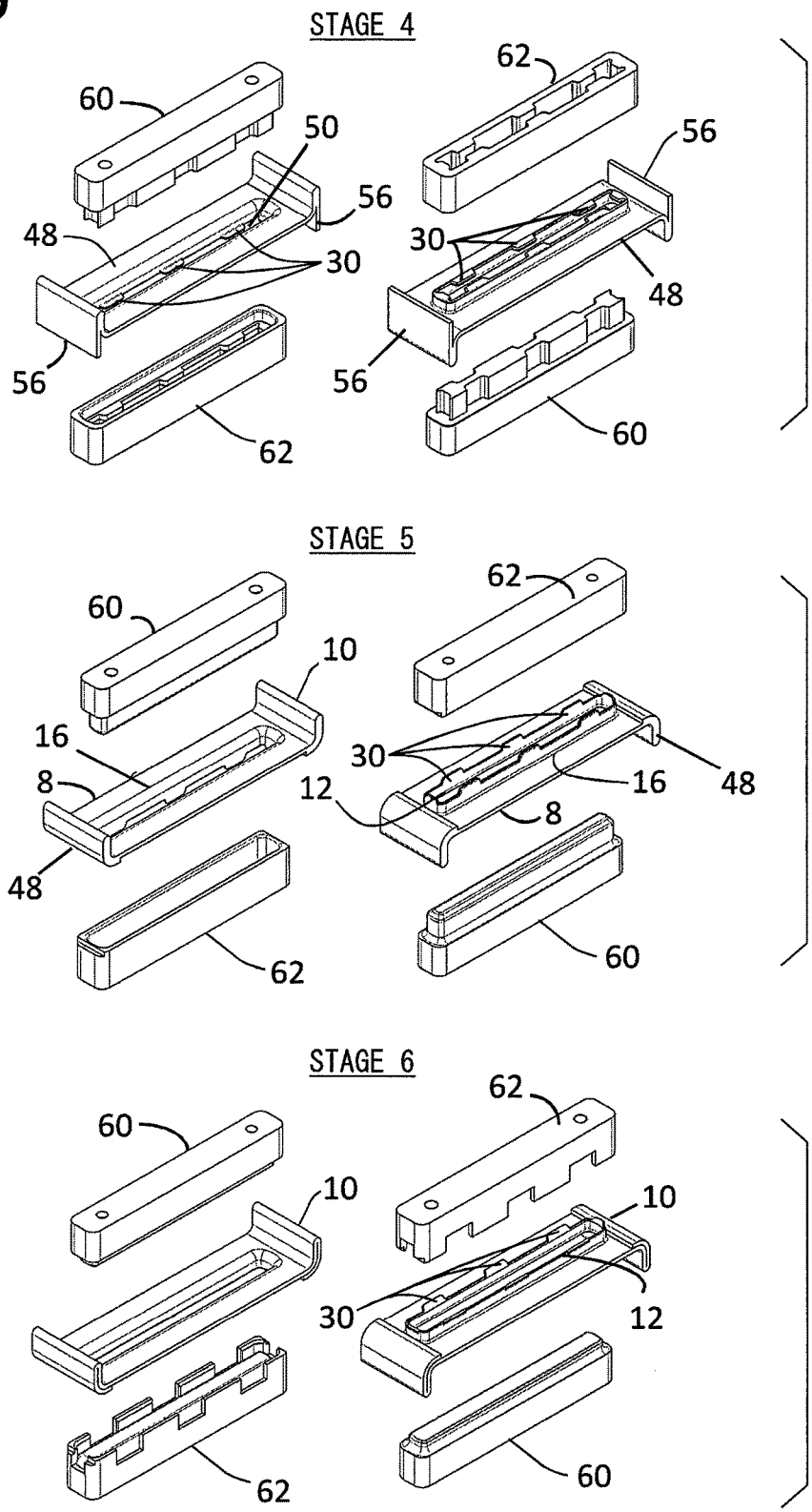
Figure 20:
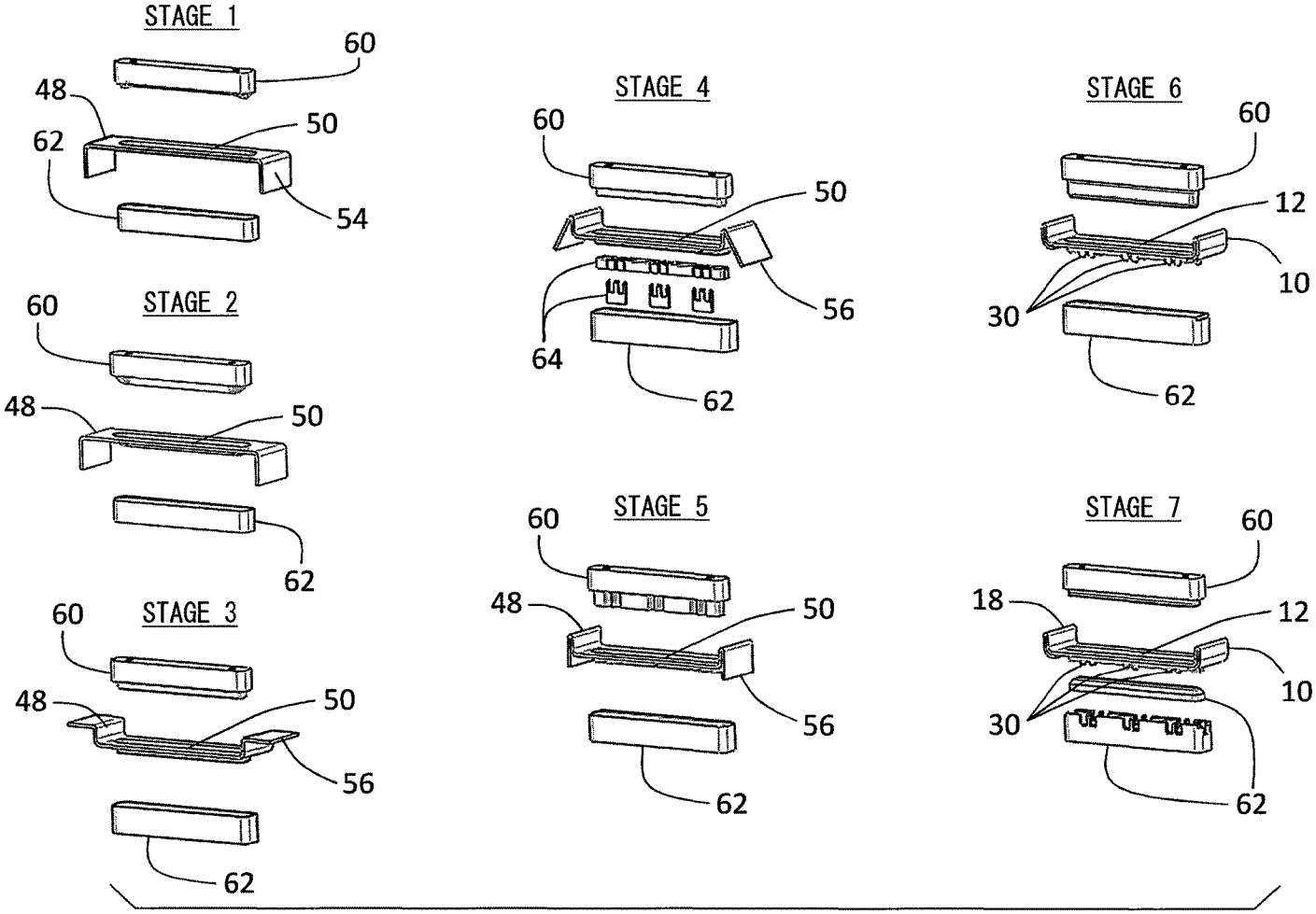
FIGS. 20 to 23 show the stages of fabrication of the header plate of the third embodiment.

FIGS. 17, 18 and 19 show the stages of the process of manufacture of the header plate 10 described in the second embodiment. Again only a single slot 12 is shown for clarity even though the header plate 10 in practice will include a plurality of slots 12, as illustrated in FIG. 12.

In stage 1 of the process a blank 48 in the form of a sheet of aluminum is taken, which has two arms 54 bent at the ends to form a channel, and is pressed beneath a top and bottom tool 60, 62 in order to create a series of grooves 50 by coining, which will eventually form the slots 12.

In stage 2, each arm 54 of the channel is then bent outwards part way along its length to form a wing 56 and the blank 48 is placed between two further tools 60, 62 to draw the groove 50 to a deeper depth, which will result in thinning of the material. As shown in FIG. 18, stage 2, the tool 60 is V-shaped in cross-section, so that the tool presents a ridge shaped contact surface, and the pressure through this tool causes the material of the floor 70 of the groove 50 to crack, resulting in a crack 72.

In stage 3, the wings 56 are bent downwards, and each groove 50 is drawn to a deeper depth by pressing between two further tools 60, 62. An additional tool 64 coins the initial tab shape.

In stage 4, each wing 56 is folded on to itself, and the blank 48 is pressed between two further tools 60, 62 to pierce the groove 50 and create the tabs 30, which at this stage will be directed inwards towards each other. Excess material is removed.

In stage 5, the material of the lip 16 is drawn to its final length by pressing between the top and bottom tools 60, 62, and the tools 60, 62 also straighten the tabs 30 so that they face downwardly. The slot 12 is now at its final dimensions. The ends of the wings 56 are folded over onto the main part 8.

In stage 6 the header plate 10 is pressed between two further tools 60, 62 and the bottom tool is shaped to flare the tabs 30 outwardly to their final position. FIG. 18 is a detail cross-sectional view of this step of the process.

FIGS. 20 to 23 show the stages of the process of manufacture of the header plate 10 described in the third embodiment. Again only a single slot 12 is shown for clarity even though the header plate 10 in practice will include a plurality of slots 12, as illustrated in FIG. 12.

In stage 1 of the process a blank 48 in the form of a sheet of aluminum is taken, which has two arms 54 bent at the ends to form a channel, and is pressed beneath a top and bottom tool 60, 62 in order to create a series of grooves 50 by coining, which will eventually form the slots 12.

Figure 21:
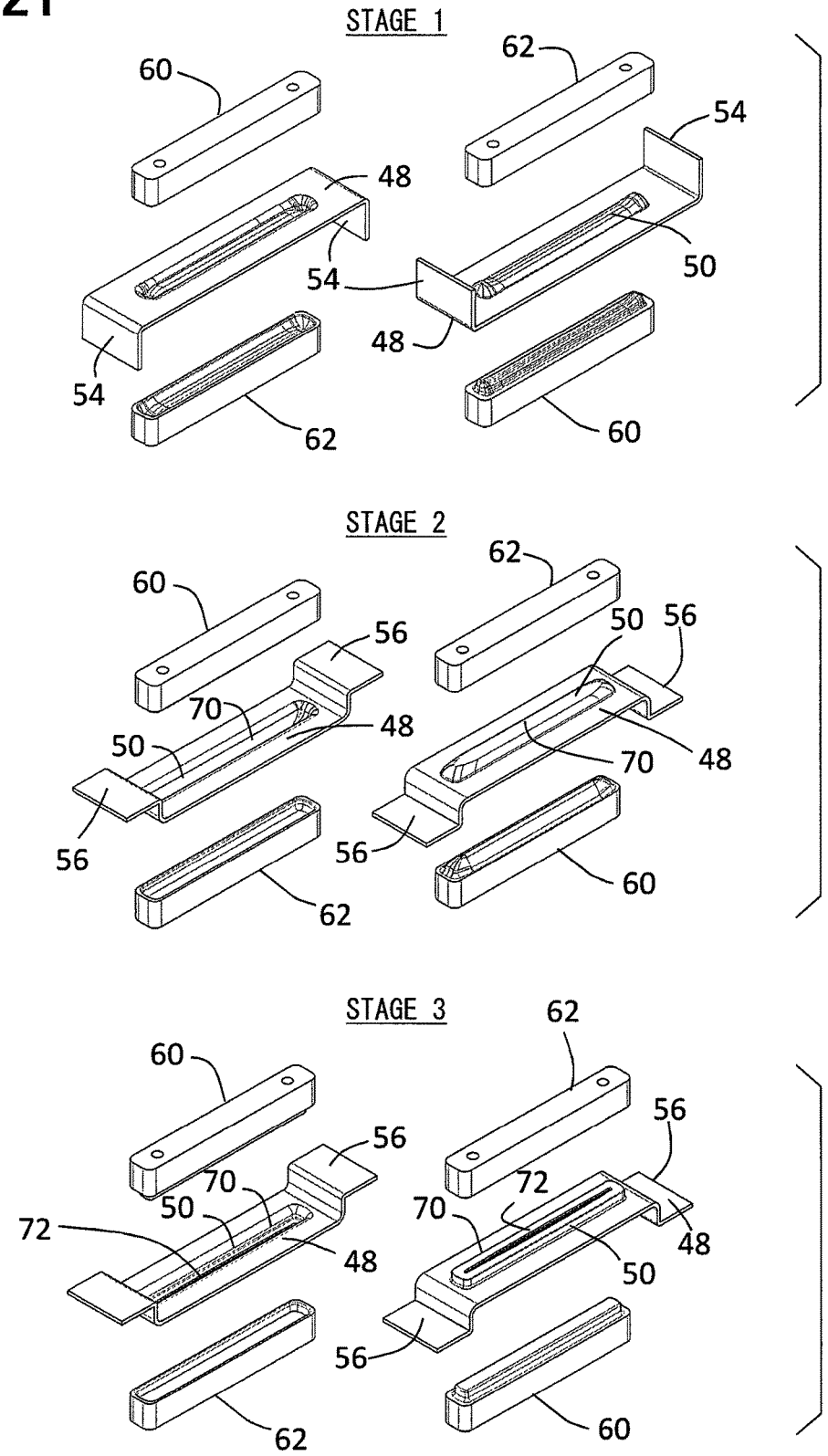
Figure 22:
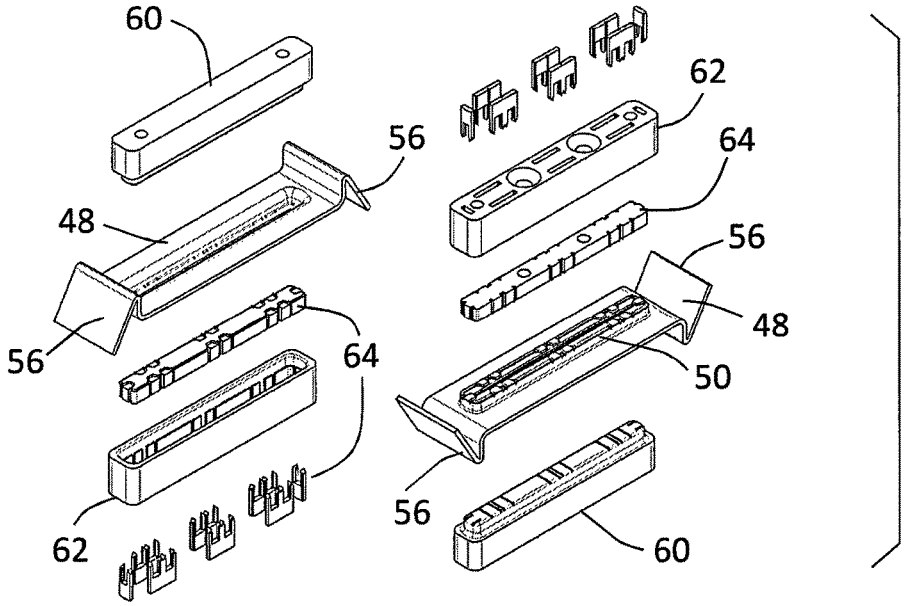
Figure 22:
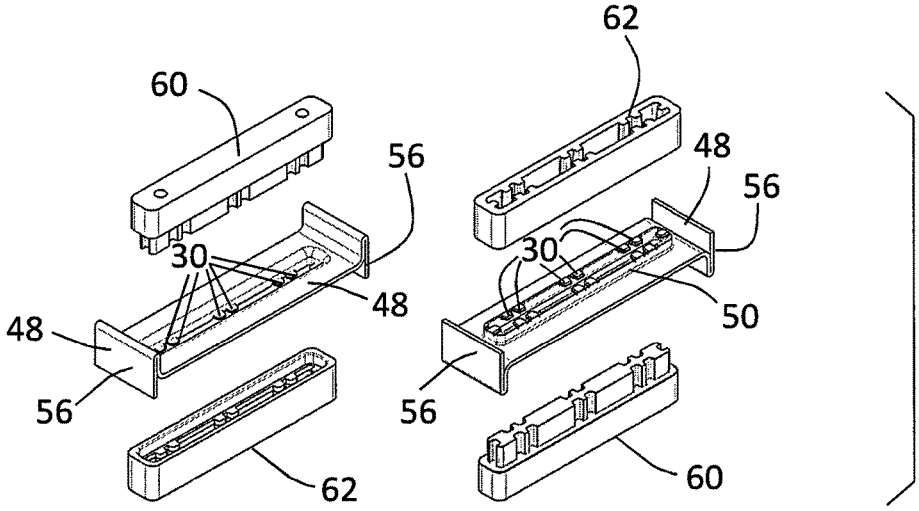
Figure 23:
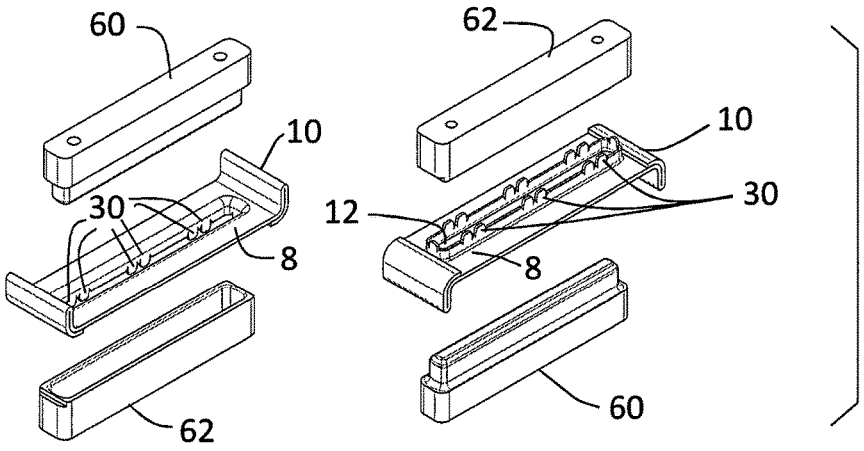
Figure 23:
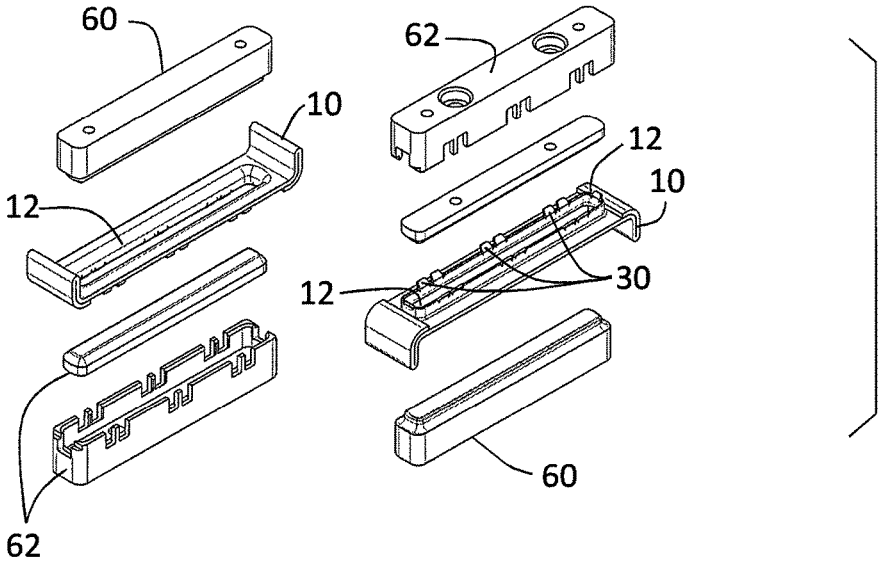

In stage 2, the blank 48 is placed between two further tools 60, 62 to draw the groove 50 to a deeper depth, which will result in thinning of the material. As shown in FIG. 21, stage 2, the tool 60 is V-shaped in cross-section and the pressure through this tool causes the material of the floor 70 of the groove 50 to crack, resulting in a crack 72.

Also in stage 2, each arm 54 of the channel is bent outwards part way along its length to form a wing 56.

In stage 3, the blank 48 is placed between two further tools 60, 62 to draw the groove 50 to a deeper depth, which will result in further thinning of the material.

In stage 4, the wings 56 are bent downwards, and each groove 50 is drawn to a deeper depth by pressing between two further tools 60, 62. An additional tool 64 coins the initial tab shape whilst piercing the tab corners.

In stage 5, each wing 56 is folded on to itself, and the blank 48 is pressed between two further tools 60, 62 to pierce the groove 50 and create the tabs 30, which at this stage will be directed inwards towards each other. Excess material is removed.

In stage 6, the material of the lip 16 is drawn to its final length by pressing between the top and bottom tools 60, 62, and the tools 60, 62 also straighten the tabs 30 so that they face downwardly. The slot 12 is now at its final dimensions. The ends of the wings 56 are folded over onto the main part 8.

Figure 24:
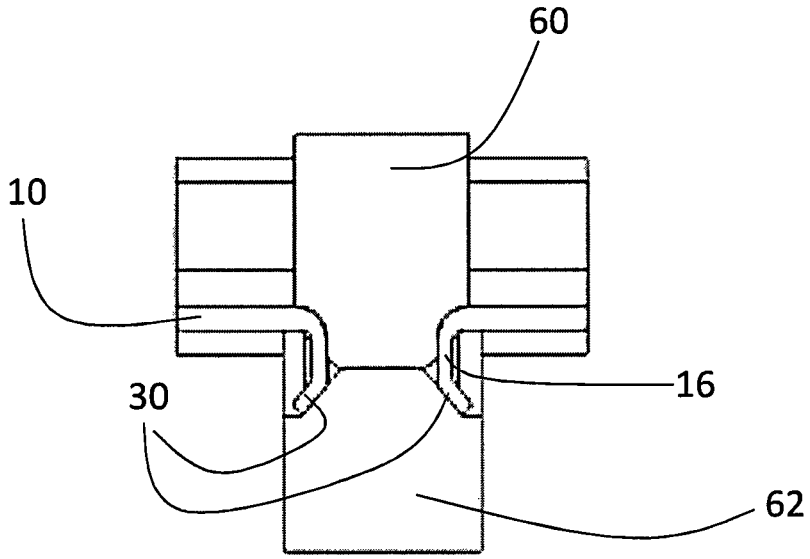
FIG. 24 is a detail view in cross-section of the header plate of the disclosure being formed by a tool.
Figure 25:
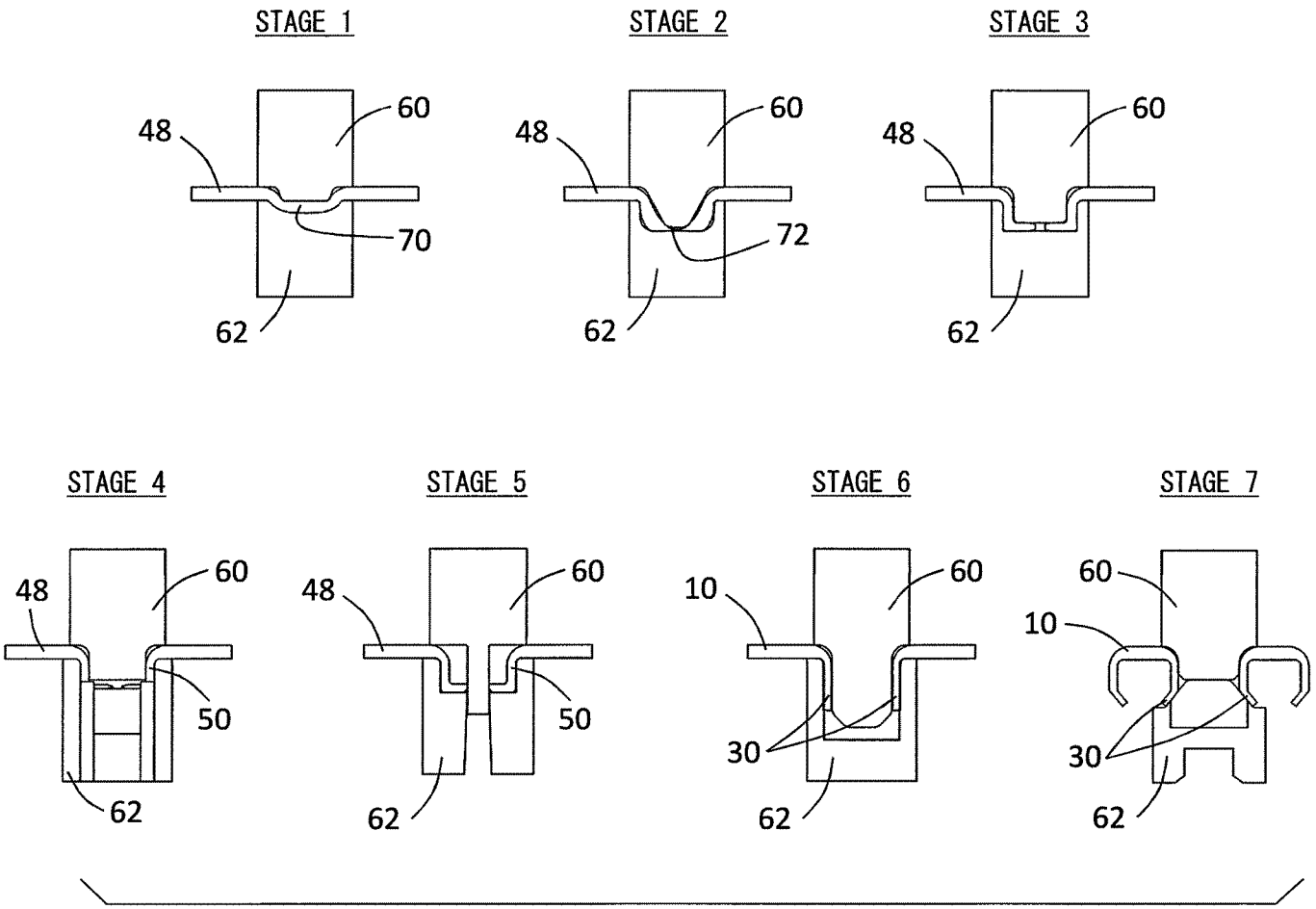
FIG. 25 is detail views in cross-section of the header plate in the stages of fabrication according to the embodiments of the disclosure.

In stage 7 the header plate 10 is pressed between two further tools 60, 62 and the bottom tool is shaped to flare the tabs 30 outwardly to their final position. FIG. 24 is a detail cross-sectional view of this step of the process.

The design of each of the embodiments could be applied equally to a radiator, CAC or oil cooler.

As described above, according to the disclosure there is provided a header plate for a heat exchanger. The header plate includes a plurality of slots to receive heat exchange tubes of the heat exchanger. The header plate includes a unit to connect to a header tank. Each slot includes a lip extending in the direction of the tubes. Each slot has substantially straight sides and having corners. The header plate further includes at least two tabs extending from each lip in the direction of the tubes. At least one tab is on one side, and at least one tab is on the opposite side of each lip. Tabs are absent from the corners of each lip. Each tab is turned out from the lip so that the tabs on a lip act as a lead in for a tube entering the slot. Each slot has two long sides opposite one another. The header plate may include a plurality of tabs on each long side of the lip.

An exemplified header plate for a heat exchanger defines slots to receive heat exchanging tubes and has a raised edge for connection to a header tank. Each slot includes a lip extending out of the plane of the header plate. Commonly this lip extends upwards in the direction of the header tank. In an alternative exemplified design, the lip extends in the direction of the tubes. In manufacture of the heat exchanger, the tubes are placed in a jig in a build machine which holds the tubes in place, then the header plate is pushed on by the build machine. If the header plate and tubes are not sufficiently accurately aligned, the end of a tube would collide with the end of a lip resulting in damage potentially.

FIG. 1A shows the stages of an exemplified process of manufacture of a header plate 10, top and bottom view shown for clarity. Only a single slot 12 is shown for clarity even though the header plate 10 in practice would include a plurality of slots 12.

In stage 1 of the process a blank 48 in the form of a sheet of aluminum is taken and is pressed or coined beneath a top and bottom tool 60, 62 in order to create a groove 50 by forming the aluminum.

Figure 1B:
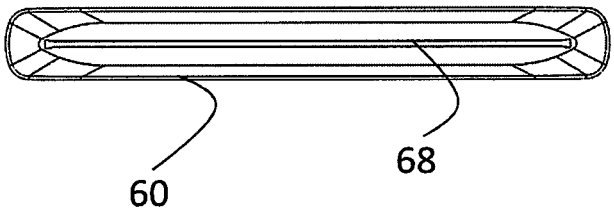
FIG. 1B is a plan view of a tool.
Figure 2:
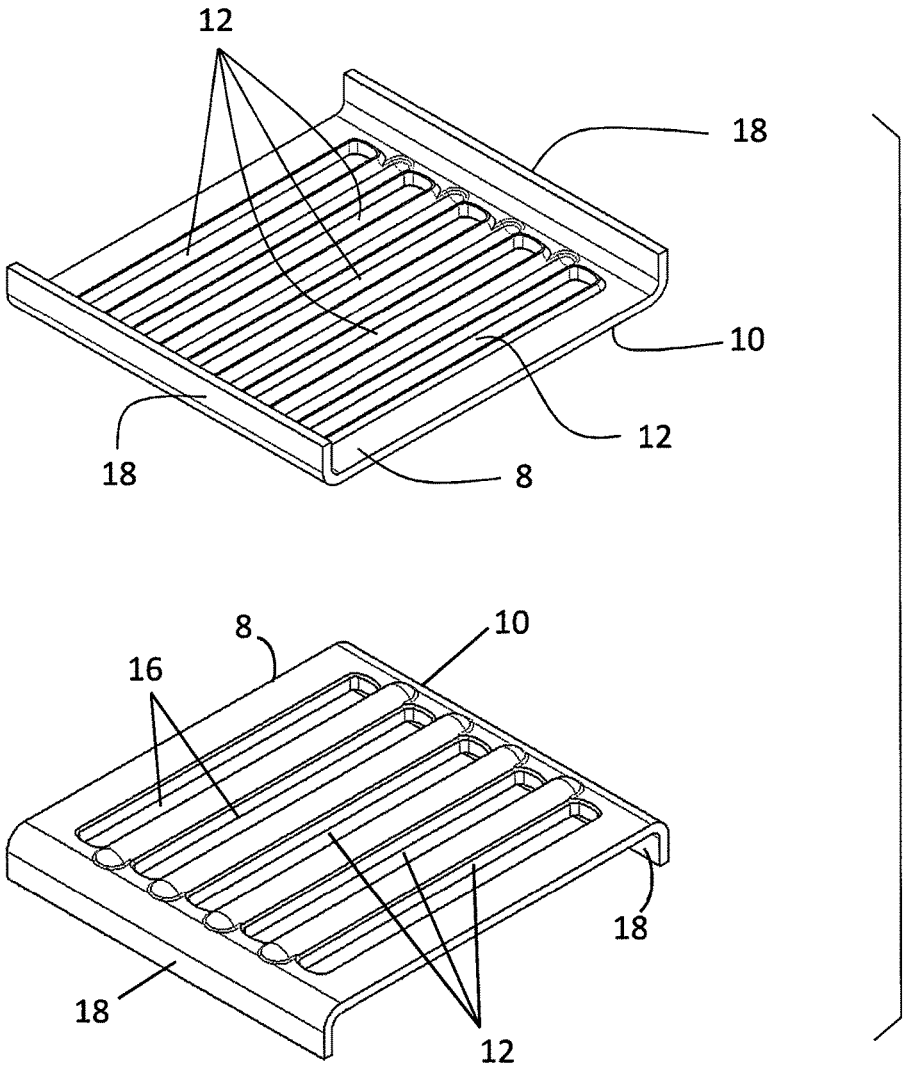
FIG. 2 is an above and underneath perspective view of an exemplified header plate.
Figure 3:
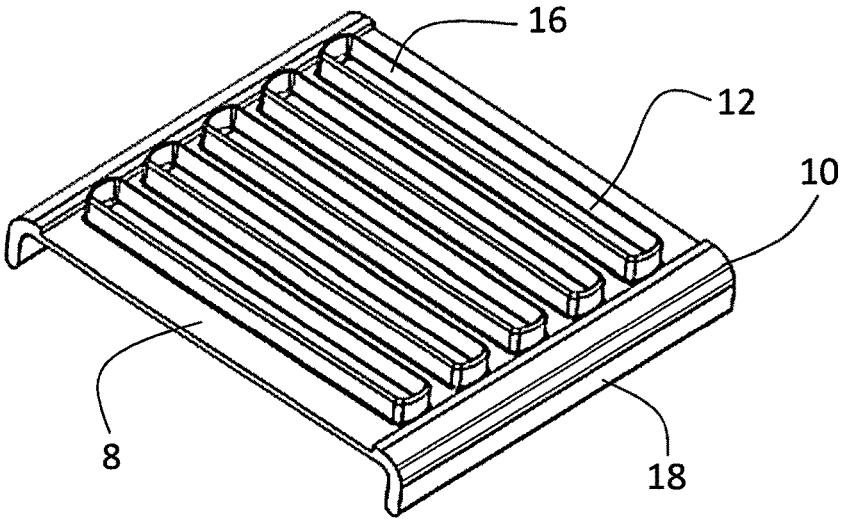
FIG. 3 is a perspective view from above of a second exemplified header plate.

In stage 2, a slot 66, commonly in the form of a 'dogbone' shape is pierced in the groove 50 by pressing between two further tools 60, 62 so that a 'dogbone' shaped protrusion 68 is pushed through the floor 70 of the groove 50 of the blank 48. The tool 60 is shown in more detail in FIG. 1B.

In stage 3, each groove 50 is plunged deeper by pressing between two further tools 60, 62 to produce the slot 12 in its final dimensions.

Concerns of using this exemplified process to produce the slot 12 would be irregular lip (or collar) 16 height, low lip (or collar) 16 height in the corners, leading to cracking in the lip corners and no or insufficient tube lead-in for resolving tube misalignment.

As described above, a method of making a header plate, the method comprises the steps of: coining a groove in a sheet metal blank; using a press tool to press the floor of the groove between two tool parts such that the floor of the groove cracks; and, pushing a tool through the floor of the groove to form a slot with a drawn lip therearound.

By forcing the material to break in a controlled position in the groove, the method of the disclosure eliminates the need to cut a dogbone slot, as in the exemplified method, and thereby leaves the maximum amount of material for the drawn lip. In particular, there is more material available in the position to form the corners of the lip, thereby minimizing stress concentration in that area. Furthermore, the material is more evenly drawn, especially in the corner areas of the lip which are prone to cracking. The method hence generates a more even or constant lip height around the slot.

At least one of the tool parts may present a ridge shaped surface. This will concentrate force along a line.

The method may further include, prior to the drawing step, piercing the groove to form a slot with tabs, and after the drawing step, flaring the tabs outwardly of the slot.

The method may include, between the steps of coining and cracking, a step of drawing the blank to increase the groove depth. This step may be in enacted by one, two or three additional coining episodes.

As described above, a header plate for a heat exchanger, the header plate includes a plurality of slots to receive heat exchange tubes of the heat exchanger. The header plate includes a unit to connect to a header tank. Each slot includes a lip extending in the direction of the tubes. Each slot having substantially straight sides and having corners. The header plate further includes at least two tabs extending from each lip in the direction of the tubes. At least one tab is on one side, and at least one tab is on the opposite side of each lip. Tabs are absent from the corners of each lip. Each tab is turned out from the lip so that the tabs on a lip act as a lead in for a tube entering the slot.

In this way, if the tubes and header plate in the build machine are not perfectly aligned, the tabs will help to guide the tubes so that they enter the slots and so that a collision does not take place between the end of a tube and the end of a lip.

Each slot may take any suitable shape, but preferably has two long sides opposite one another, in which case there is preferably at least one tab on each long side of the lip. There may be only one tab on each long side of the lip. Alternatively there may be a plurality of tabs on each long side of the lip, and the tabs may be regularly arranged along each side. In one embodiment there are only two tabs on each long side of the lip. In another embodiment there are only three tabs on each long side of the lip. In another embodiment each of the tabs on each long side of the lip is split into two smaller parts making double the number of tabs on each long side of the lip. In other words, there can be pairs of tabs along each side of the lip.

Each slot may be elongate with two rounded corners facing one another, or may be substantially rectangular, hence defining four corners. The header plate may then include one tab on each short side of the lip. Each tab on a short side of the lip may have a width where it connects to the lip of no more than 55% of the width of the slot.

Each tab may extend away from the lip by a distance of at least 1 mm, preferably at least 3 mm. Each tab may extend away from the lip by a distance of not more than 6 mm.

Each tab may be any suitable shape and may be rectangular or rounded. In a embodiment, each tab is broader at the root than at the free end. Each tab may be substantially triangular or preferably each tab is substantially trapezium shaped.

Each tab may be turned out from the lip at an angle in the range 25 to 45°, preferably in the range 30 to 40°.

The width of each tab where it connects to the lip may be no more than 7 mm.

The header plate may be made of aluminum in the range 1 to 5 mm in gauge.

According to a further aspect of the disclosure there is provided a method of making a header plate, the method comprising the steps of: coining a groove in a sheet metal blank, piercing the groove to form a slot with tabs, and flaring the tabs outwardly of the slots.

The method may include, between the steps of coining and piercing, a step of drawing the blank to increase the groove depth.

According to another aspect of the disclosure there is provided a method according to the preceding aspect of the disclosure for making a header plate according to the second aspect of the disclosure.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A header plate for a heat exchanger, the header plate comprising:

a unit to connect to a header tank;

a plurality of slots to receive heat exchange tubes of the heat exchanger; each slot including a lip extending in a direction of the tubes, each slot having straight sides and having corners; and at least two tabs extending from each lip in the direction of the tubes, at least one tab being on one side and at least one tab being on an opposite side of each lip, tabs being absent from the corners of each lip, each tab being turned out from the lip so that the tabs on the lip act as a lead in for a tube entering the slot, each slot having two long sides opposite one another, wherein at least one tab is on each long side of the lip, the at least one tab is split in two smaller parts, each of the two smaller parts has a width along each long side of the lip, the two smaller parts are disposed away from each other with a space along each long side of the lip, and the width of each of the two smaller parts is greater than the space between the two smaller parts.

2. The header plate as claimed in claim 1, wherein the tabs are regularly arranged along each long side.

3. The header plate as claimed in claim 1, wherein the header plate includes only two tabs on each long side of the lip.

4. The header plate as claimed in claim 1, wherein the header plate includes only three tabs on each long side of the lip.

5. The header plate as claimed in claim 1, wherein the header plate includes pairs of tabs along each side of the lip.

6. The header plate as claimed in claim 1, wherein each slot is rectangular.

7. The header plate as claimed in claim 1, wherein the header plate includes one tab on each short side of the lip.

8. The header plate as claimed in claim 7, wherein each tab on a short side of the lip has a width where it connects to the lip of no more than 55% of the width of the slot.

9. The header plate as claimed in claim 1, wherein each tab extends away from the lip by a distance of at least 1 mm.

10. The header plate as claimed in claim 1, wherein each tab extends away from the lip by a distance of at least 3 mm.

11. The header plate as claimed in claim 1, wherein each tab extends away from the lip by a distance of not more than 6 mm.

12. The header plate as claimed in claim 1, wherein each tab is broader at the root than at the free end.

13. The header plate as claimed in claim 1, wherein each tab is trapezium shaped.

14. The header plate as claimed in claim 1, wherein each tab is turned out from the lip at an angle in the range 25 to 45°.

15. The header plate as claimed in claim 1, wherein each tab is turned out from the lip at an angle in the range 30 to 40°.

16. The header plate as claimed in claim 1, wherein the width of each tab where it connects to the lip is no more than 7 mm.

17. The header plate as claimed in claim 1, wherein the header plate is made of aluminum in the range 1 to 5 mm in gauge.

* * * * *